United States Patent [19]

Mori et al.

[11] Patent Number: 5,035,016

[45] Date of Patent: Jul. 30, 1991

[54] AIR-MAT APPARATUS

[75] Inventors: Tamotsu Mori; Katsuji Kikuchi, both of Tokyo, Japan

[73] Assignee: Nikko Co., Ltd., Tokyo, Japan

[21] Appl. No.: 617,373

[22] Filed: Nov. 26, 1990

Related U.S. Application Data

[63] Continuation of Ser. No. 268,870, Nov. 8, 1988, abandoned.

[30] Foreign Application Priority Data

Nov. 10, 1987 [JP] Japan ..... 62-170784[U]

[51] Int. Cl.[5] ..... A47C 27/08

[52] U.S. Cl. ..... 5/453; 5/455

[58] Field of Search ..... 5/453, 454, 455, 446, 5/456

[56] References Cited

U.S. PATENT DOCUMENTS

| | | | |
|---|---|---|---|
| 4,175,297 | 11/1979 | Robbins et al. | 5/453 X |
| 4,197,837 | 4/1980 | Tringali et al. | 5/453 X |
| 4,472,847 | 9/1984 | Gammons et al. | 5/453 |
| 4,583,255 | 4/1986 | Mogaki et al. | 5/453 |
| 4,622,706 | 11/1986 | Takeuchi | 5/455 X |
| 4,653,130 | 3/1987 | Senoue et al. | 5/453 |
| 4,711,275 | 12/1987 | Ford et al. | 5/455 X |
| 4,797,962 | 1/1989 | Goode | 5/453 |
| 4,825,486 | 5/1989 | Kimura et al. | 5/455 X |
| 4,829,616 | 5/1989 | Walker | 5/455 X |

FOREIGN PATENT DOCUMENTS

| | | | |
|---|---|---|---|
| 1456058 | 10/1966 | France | 5/455 |

*Primary Examiner*—Gary L. Smith
*Assistant Examiner*—Michael J. Milano
*Attorney, Agent, or Firm*—Nixon & Vanderhye

[57] ABSTRACT

In an air-mat apparatus, air mat has four air bags, two of which have a plurality of air-jetting holes and two others of which have no holes. In a preferred embodiment, the bags having the air-jetting holes are arranged in a zigzag pattern while the remaining two bags are arranged in a comb-shaped pattern. Air ports for the bags having air-jetting holes are connected through flowrate-adjusting valves to an air-distributing valve, while the air ports of the bags having no holes are also connected to the air-distributing valve but not through the flowrate-adjusting valves. The arrangement permits two of the air bags to be inflated and deflated to a specific degree, and the other two air bags to be inflated and deflated to a different degree.

9 Claims, 5 Drawing Sheets

AIR-MAT APPARATUS

This is a continuation of application Ser. No. 07/268,870 filed Nov. 8, 1988, now abandoned.

BACKGROUND OF THE INVENTION

1. Field of the Invention

The present invention relates to an air-mat apparatus which make use of pressurized air to relieve elderly people, who have been long in bed, from bedsores.

2. Description of the Related Art

As is shown in FIG. 1, the conventional air-mat apparatus of such a type comprises air pump 30 for supplying pressurized air, an air mat 36, solenoid valves 34 connecting the air mat 36 to pump 30, and control circuit 35 for controlling solenoid valves 34. The air mat 36 comprises elongated air bags 31 arranged parallel to one another, and a zigzag air bag 32 having holes 32'. Zigzag air bag 32 is connected one of solenoid valves 34, and air bags 31 are connected to the remaining solenoid valves 34, respectively. Valves 34 are connected to air pump 30.

In operation, control circuit 35 controls solenoid valves 34, thus supplying the pressurized air from air pump 30 to air bags 31 and zigzag air bag 32, such that any two adjacent air bags 31 are alternately inflated, and the air is jetted outward through holes 32' of zigzag air bag 32. As air bags 32 are repeatedly inflated and deflated, they message the occupant of the air mat. Further, the air jetted outward through holes 32' of zigzag air bag 32 dries the clothes which the occupant wears, thus keeping the occupant's skin moderately dry.

Solenoid valves 34, however, cannot be controlled so precisely as to supply the pressurized air to the air mat 36 at a rate optimum to the physical conditions of the occupant of the air mat. The conventional air-mat apparatus is inevitably unable to relieve the occupant completely from bedsores. In particular, it is difficult with the conventional apparatus to adjust the supply of air to zigzag air bag 32 so as to maintain the occupant's skin properly dry.

SUMMARY OF THE INVENTION

It is accordingly the object of the present invention to provide an air-mat apparatus which can change the degree to which elongated, parallel air bags of the air mat are repeatedly inflated and deflated, thus massaging the occupant of the air mat to successfully relieve him or her from bedsores, and which can also adjust the supply of air to the zigzag air bag of the air mat in accordance with the physical conditions of the occupant, thereby to keep his or her skin appropriately dry.

According to the present invention, there is provided, to achieve this object, an air-mat apparatus which comprises pressurized air source, and at least four air bags, two of a zigzag configuration, and two of a comb-shaped configuration, the first bag having no holes and the second bag having air-jetting holes forming a first group, and the third bag having no holes and the fourth bag having air-jetting holes forming a second group, and wherein pressurized air is alternately supplied from the pressurized air source to the two groups of air bags, and alternately discharged therefrom. The air-mat apparatus also comprises an air pipe connected to the pressurized air source, a pressure-controlling valve connected to the air pipe for controlling the pressure of the air supplied from the pressurized air source, an air-distributing valve connected to the pressure-controlling valve for distributing the air from the pressure-controlling valve into at least two streams, at least four branch pipes connected, at one end, to the air distributing valve, and at the other end, to the zigzag air bags, respectively, and at least two flowrate-adjusting valves provided in the branch pipes connected to those zigzag air bags which have holes.

As has been described above, the air-mat apparatus of the invention has at least two groups of air bags, each group consisting of the first bag having no -holes and the second bag having air-jetting holes, and pressurized air is alternately supplied to these groups of bags. The pressurized air is first supplied to the bags of the first group. Then, both bags of the first group are inflated, and the air is jetted outward through the air-jetting holes of the second bag. When the supply of air to the first group of bags is stopped, both bags are deflated. As soon as the supply of air to the bags of the first group is stopped, the pressurized air is supplied to the bags of the second group. Thus, both bags of the second group are inflated, and the air is jetted outward through the air-jetting holes of the second bag. When the supply of air to the second group of bags is stopped, the air is then supplied to the bags of the first group, if the apparatus has only two groups of bags, or to the third group of bags, if the apparatus has three or more groups of bags.

As the pressurized air is alternately supplied to the groups of bags, the bags of one group are inflated, while those of the other group are deflated, thereby massaging the occupant of the air mat. Simultaneously, the air is jetted outward through the air-jetting holes of one of the bags inflated, thus keeping the occupant's skin moderately dry. Since the occupant is thus massaged, and his or her skin is maintained dry, he or she has no bedsores.

The air pressure in each air bag is controlled independently of that in any other air bag, by operating the pressure-controlling valve provided in the branch pipe connected to the bag. Therefore, the rate at which the air is jetted from any bag having air-jetting holes, can be adjusted without changing the air pressure within the bags having no holes. The air pressure in any bag having no holes can be maintained at an optimum value, by operating the pressure-controlling valve connected to the bag.

DETAILED DESCRIPTION OF THE PREFERRED EMBODIMENTS

An air-mat apparatus according to a first embodiment of this invention will now be described in detail, with reference to the accompanying drawings.

Figure 2:
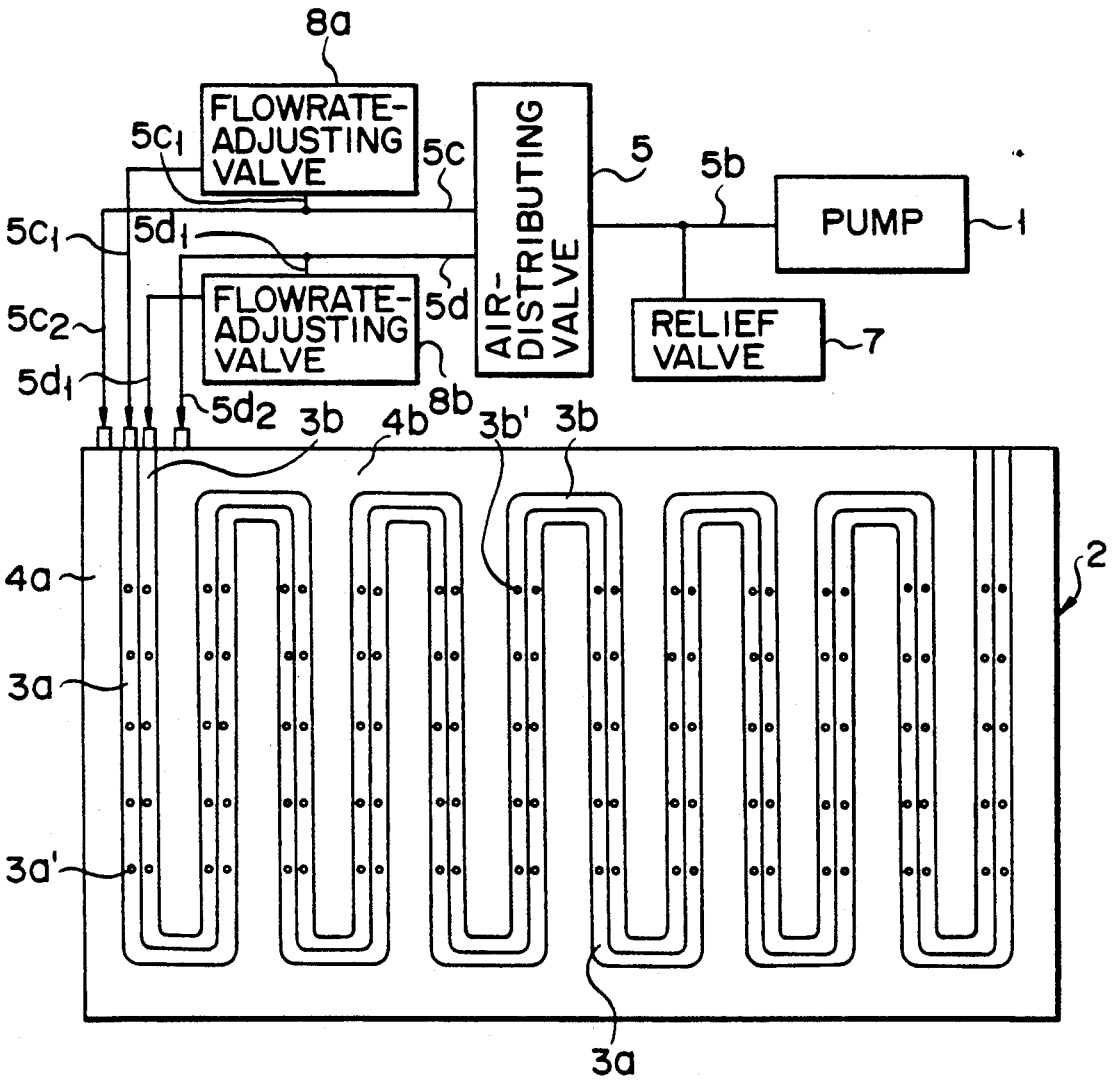
FIG. 2 is a block diagram showing an air-mat apparatus according to one embodiment of the present invention.

As is shown in FIG. 2, this air-mat apparatus comprises air pump 1 used as a pressurized air source, and rectangular air mat 2 connected to air pump 1 by air supply pipes.

Air mat 2 has two air bags 3*a* and 3*b* and two air bags 4*a* and 4*b*, which are separated from one another and can be inflated and deflated. Air bags 3*a* and 3*b* have air-jetting holes 3*a*' and 3', whereas air bags 4*a* and 4*b* have no holes. Four air bags 3*a*, 3*b*, 4*a*, and 4*b* are arranged in the specific pattern shown in FIG. 2. More specifically, bags 3*a* and 3*b*, both having air-jetting holes, extend in a zigzag pattern and are arranged adjacent to each other. That is, they are bent at several locations, first in the widthwise direction of air mat 2 and then in the lengthwise direction thereof. Air bags 4*a* and 4*b* are separated from each other by the zigzag air bags 3*a* and 3*b*, and are shaped like combs. The finger-like portions of either airbag having no holes are located among those portions of air bags 3*a* and 3*b* which extend in the widthwise direction of air mat 2.

Air-jetting holes 3*a*' and 3*b*', which are made in zigzag air bags 3*a* and 3*b*, are tiny ones. Air-jetting holes 3*a*' and 3*b*' are made, such that holes 3*a*' are located side by side with holes 3*b*' as is shown in FIG. 2. Alternatively, air-jetting holes 3*a*' and 3*b*' can be made, such that holes 3*a*' are staggered with respect to holes 3*b*'. As is evident from FIG. 2, bags 3*a* and 3*b*, both having air-jetting holes, are thinner than bags 4*a* and 4*b*, which have no holes.

The air mat 2 of the present embodiment has four air bags. Nonetheless, the invention can apply to an air mat having any other number of air bags, as far as the bags having air-jetting holes and the bags having no holes are provided in the same number which is a multiple of 2.

Air supply pipes 5*c*1, 5*c*2, 5*d*1, and 5*d*2 are connected, at one end, to air supply ports of air bags 3*a*, 3*b*, 4*a*, and 4*b*, respectively, for supplying pressurized air (described later) to these bags, and discharging the air therefrom. Air-distributing valve 5 is connected between air pump 1, on the one hand, and air supply pipes 5*c*1, 5*c*2, 5*d*1, and 5*d*2, on the other hand. Valve 5 can be closed and opened to any desired opening.

Figure 3:
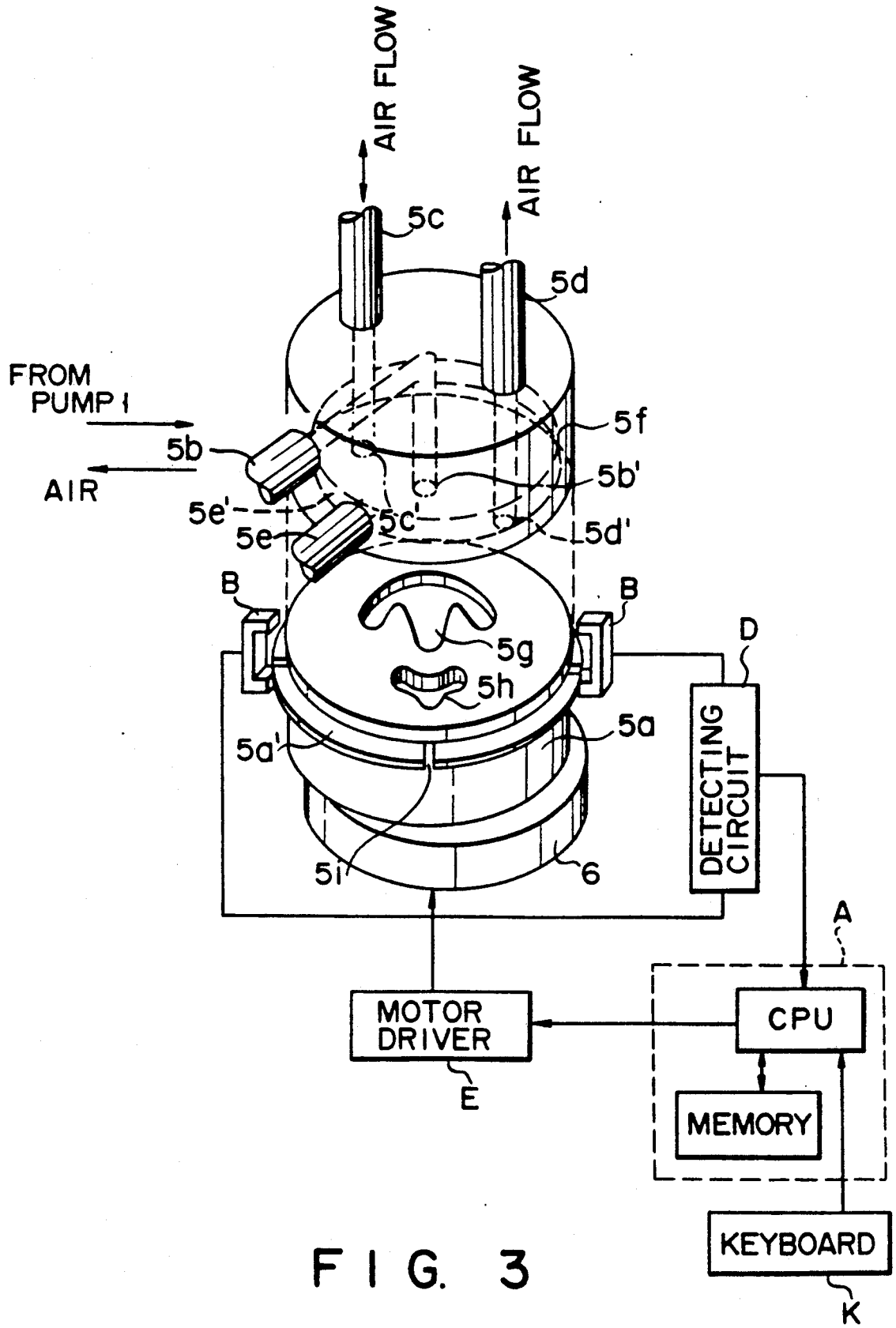
FIG. 3 is a perspective view of the air-distributing valve used in the apparatus shown in FIG. 2, and also illustrating the peripheral devices of the air-distributing valve.
Figure 4:
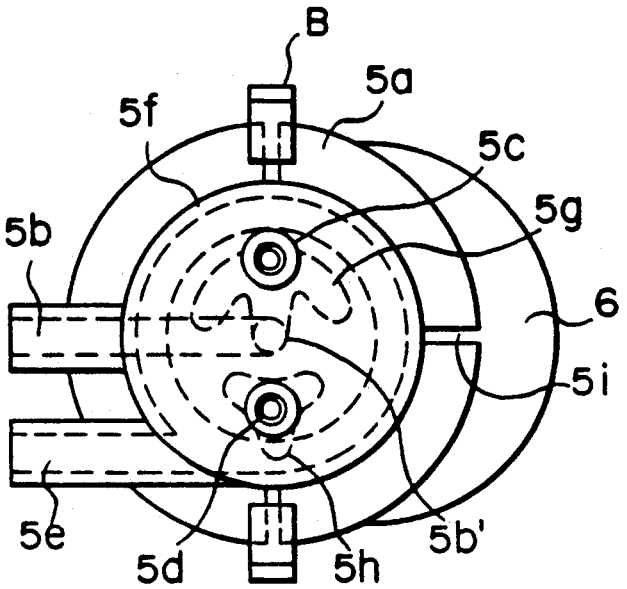
FIGS. 4 and 5 are a plan view and a side view of the air-distributing valve shown in FIG. 3.
Figure 5:
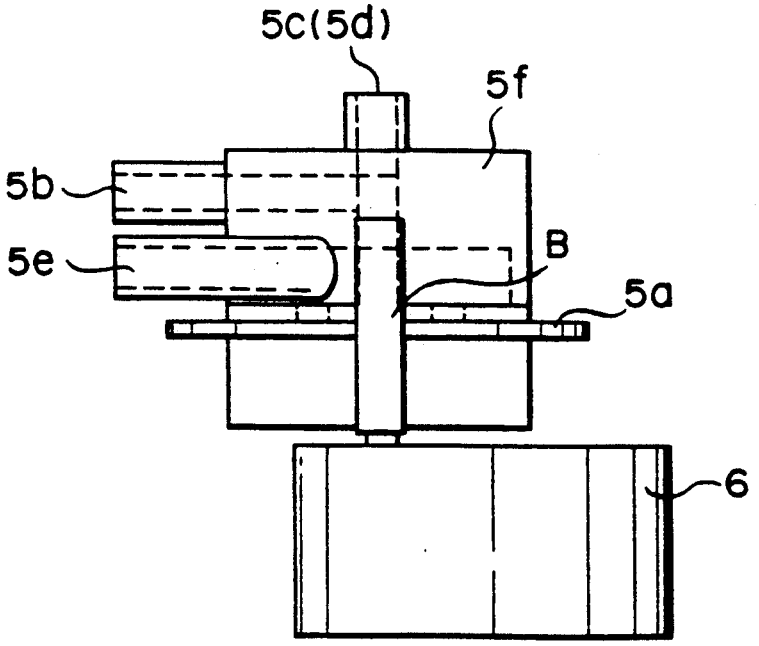

Air-distributing valve 5 is illustrated in detail in FIGS. 3, 4 and 5. As is shown in these figures, valve 5 comprises a rotary section and a fixed section 5*f*. The rotary section 5*a* has disk 5*a*' as the main component, which can be rotated by motor 6. Fixed section 5*f* has air supply pipe 5*b*, air supply/discharge pipes 5*c* and 5*d*, and air discharge pipe 5*e*. Pipes 5*b*, 5*c*, 5*d*, and 5*e* have ends 5*b*', 5*c*', 5*d*', and 5*e*' which open in the lower surface of fixed section 5*f* mounted on rotary disk 5*a*. Two grooves 5*g* and 5*h* are made in the upper surface of disk 5*a*, and located substantially in the same circle. Groove 5*g* is generally T-shaped, consisting of an arcuate portion concentric to disk 5*a* and a straight portion extending from the arcuate groove to a position right below the end 5*b*' of air supply pipe 5*b*. Groove 5*h* is generally Y-shaped, consisting of a short arcuate portion of the same curvature as groove 5*g* and a straight portion extending from the arcuate groove to a position right below the end 5*e*' of air discharge pipe 5*e* and in the same diameter of disk 5*a* as the straight groove of groove 5*g*. The arcuate portion of groove 5*g* is located below the open end 5*c*' of air supply/discharge pipe 5*c*, and the arcuate portion of groove 5*h* is located below the open end 5*d*' of air supply/discharge pipe 5*d*. Groove 5*g* has a width slightly larger than the inside diameter of pipe 5*b*. Similarly, groove 5*h* has a width slightly larger than the inside diameter of pipe 5*d*.

Disk 5*a* can be rotated by motor 6, and can be stopped at various positions, such that air supply pipe 5*b* is alternately connected to air supply/discharge pipes 5*c* and 5*d* through groove 5*g*, and air discharge pipe 5*e* is alternately connected to air supply/discharge pipes 5*c* and 5*d* through groove 5*h*.

Disk 5*a* has a flange which has four notches 5*i* spaced apart equidistantly in the circumferential direction of disk 5*a*. Two photosensors B straddle the flange, thereby to detect these notches 5*i*. Either photosensor B outputs an electrical signal whenever it detects any notch 5*i*. The signal is supplied to detecting circuit D. Circuit D converts the signal into a position signal representing the position of disk 5*a*. The position signal is supplied to control circuit A which comprises a CPU and a memory. Control circuit A generates a motor control signal in accordance with the difference in magnitude between the position signal supplied from circuit D and the reference signal input by operating keyboard K and representing a desired position of disk 5*a*. The motor control signal is supplied to motor driver E. In response to the motor control signal, motor driver E drives motor 6, whereby disk 5*a* is rotated to the desired position which is represented by the reference signal.

Since disk 5*a* is rotated to any desired position by inputting a reference position signal to control circuit A by operating keyboard K, the pressurized air is supplied to or discharged from air bags 3*a*, 3*b*, 4*a*, and 4*b* at desired times for desired periods. As result, air bags 3*a*, 3*b*, 4*a*, and 4*b* can be inflated and deflated to degrees optimum to the occupant of air mat 2.

As is shown in FIG. 2, relief valve 7 is connected to air supply pipe 5*b* connecting air-distributing valve 5 to air pump 1 (i.e., the pressurized air source). Relief valve 7, which functions as a pressure-controlling valve, is automatically opened when the pressure within air-distributing valve 5 rises above a predetermined value when pipes 5*b*, 5*c*, 5*d* and 5*e* are all closed. Hence, valve 5 is not pressurized excessively, and is prevented from being broken.

Air supply/discharge pipe 5*c* is branched into two pipes 5*c*1 and 5*c*2. Similarly, air supply/discharge pipe 5*d* is branched into two pipes 5*d*1 and 5*d*2. Flowrate-adjusting valve 8*a* is provided in pipe 5*c*1 coupled to air bag 3*a*, and flowrate-adjusting valve 8*b* is provided in pipe 5*d*1 connected to air bag 3*b*. These valves 8*a* and 8*b* adjust, to any desired values, the rates at which the pressurized air is jetted outward bags from 3*a* and 3*b* through air-jetting holes 3*a*' and 3*b*'. Flowrate-adjusting valves are identical in structure.

Figure 1:
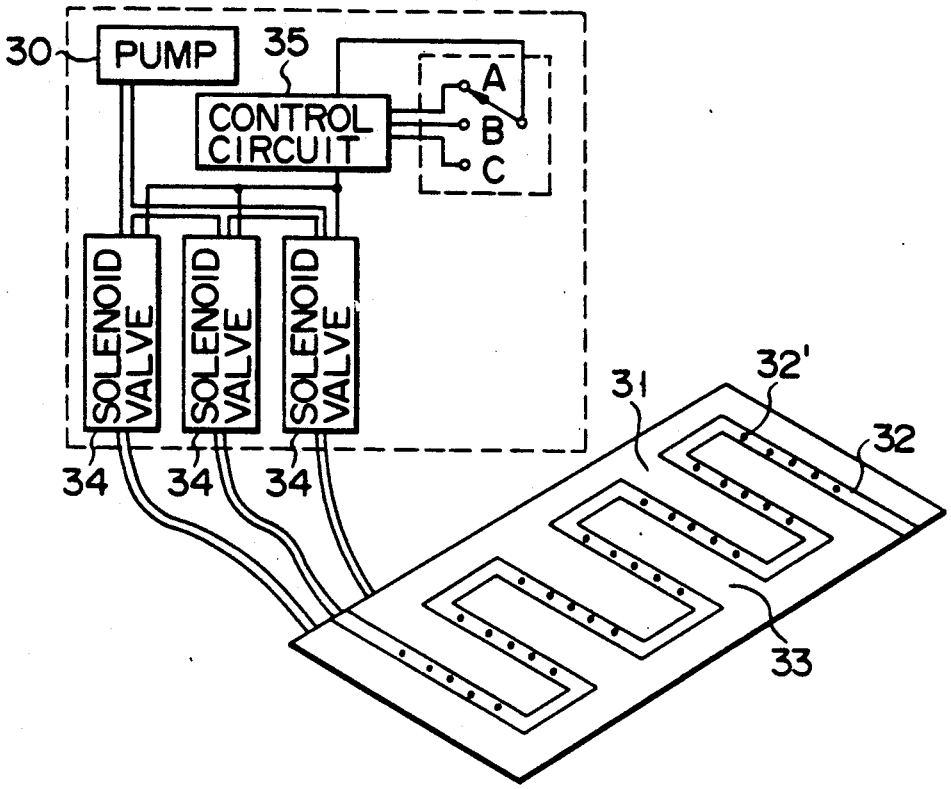
FIG. 1 is a block diagram showing a conventional air-mat apparatus.
Figure 6:
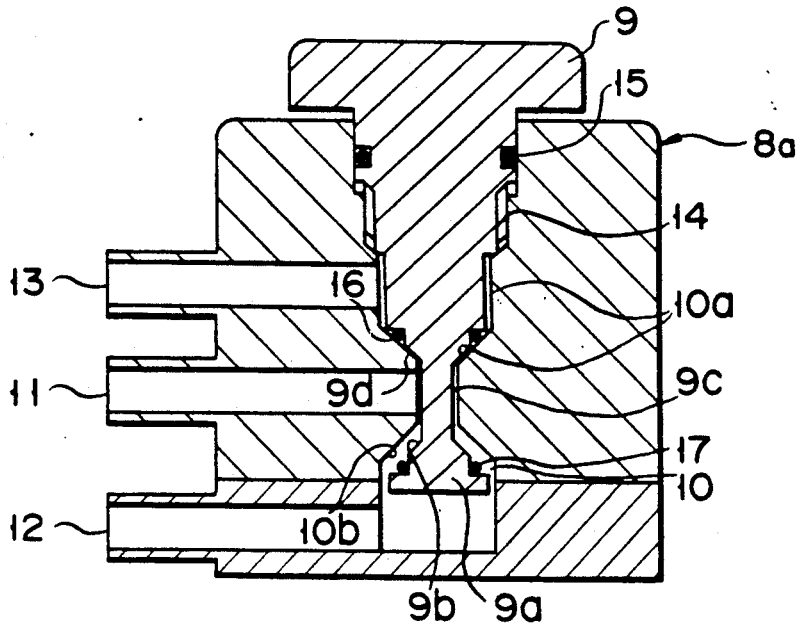
FIG. 6 is a vertical sectional view of the flowrate-adjusting valve used in the apparatus shown in FIG. 2.

As is shown in FIG. 6, flowrate-adjusting valve 8*a* (valve 8*b* is identical to 8*a* so that only valve 8*a* need be described) comprises valve 9 having a valve body 9*a* shaped like a bobbin, and valve chamber 10 shaped complementary with valve body 9*a*. Valve 8 has air-supply port 11, air-discharge port 12, and air-jetting port 13. Valve body 9*a* is in screw engagement with chamber 10. Valve body 9*a* comprises first conical section 9*b*, thin rod-like section 9*c* connected to the upper end of first conical section 9*b*, and second conical section 9*d* connected to the upper end of rod-like section 9c. Valve chamber 10 has first tapered portion 10a and second tapered portion 10b. Valve body 9a is moved up or down (FIG. 6) when it is rotated.

Flowrate-adjusting valve 8a is operated in the following manner, thereby to adjust the flowrate of jetting the air outward through the holes of the air bag to which valve 8a is connected. When valve body 9a is lowered until section conical 9d abuts on first tapered portion 10a, air-supply port 11 communicates with air-discharge port 12 through valve chamber 10. Since port 12 opens to the atmosphere, the pressurized air supplied from air pump 1 escapes into the atmosphere through port 12. When valve body 9a is lifted until first conical section 9b abuts on second tapered portion 10b, air-supply port 11 communicates with air-jetting port 13 via valve chamber 10. Since port 13 is connected to air bag 3a or 3b, the pressurized air is supplied to this air bag. Further, when valve body 9a is located between the upper position and the lower position, none of the portions of body 9 abuts on first tapered portion 10a or second tapered portion 10b. In this case, part of the pressurized air is discharged into the atmosphere through air-discharge port 12, and the remaining portion of the air is supplied via air-jetting port 13. Hence, the flowrate of the air supplied to air bag 3a or 3b through pipe 13 is adjusted by rotating valve 9, thus moving valve body 9a between its upper and lower positions.

Bobbin-shaped valve body 9a has portion 14 having a diameter smaller than the inside diameter of that portion of valve chamber 10 in which it is located. Thus, a relatively broad gap is formed between portion 14 and the periphery of chamber 10. Due to this gap, the pressurized air can be discharged to the atmosphere through port 12 and also can be supplied to air bag 3a or 3b via air-jetting port 13 as long as valve body 9a remains in the neutral position between its upper and lower positions.

Either flowrate-adjusting valve 8a or b incorporated in the air-mat apparatus according to this invention is not limited to the embodiment shown in FIG. 6. Rather, a valve of another structure can be employed.

As is also illustrated in FIG. 6, flowrate-adjusting valve 8a further comprises packing 15 and two O-rings 16 and 17. Packing 15 serves to present the pressurized air from leaking from any gap between valve body 9a and valve chamber 10. O-ring 16 disables the pressurized air from flowing through between first conical portion 9b of body 9a and second tapered portion 10b of valve chamber 10. Similarly, O-ring 17 disables the air from flowing through between second conical portion 9c of body 9a and first tapered portion 10a of valve chamber 10.

Now it will be explained how the air-mat apparatus described above operates.

When air pump 1 is driven, it starts supplying pressurized air. Pressure-controlling valve 7 maintains the air at a predetermined pressure. The air, thus controlled, is supplied to air-distribution valve 5. Disk 5a of valve 5 is rotated by motor 6 at a constant, relatively low speed. As disk 5a is rotated in this way, air supply pipe 5b and air supply/discharge pipe 5c or 5d communicate through T-shaped groove 5g, and air discharge pipe 5e and air supply/discharge pipe 5d or 5c communicate via Y-shaped groove 5h. As a result, air-distributing valve 5 distributes the pressurized air supplied from pump 1, in the way as will be explained, and eventually supplies the air mat 2 via supply/discharge pipe 5c or 5d.

First, when air supply pipe 5b communicates with pipe 5c through groove 5g, part of the pressurized air supplied from air pump 1 is supplied through pipe 5c to air bag 4a. Meanwhile, the remaining part of the air flows into flowrate-adjusting valve 8a. The air controlled by valve 8a is supplied to air bag 3a. Hence, air bags 3a and 4a are inflated simultaneously. The air is jetted from air bag 3a through air-jetting holes 3a' at the desired rate, against the back of the occupant of air mat 2.

In order to adjust the rate at which to jet the air through air-jetting holes 3a', valve 9 is rotated in either direction, thereby varying the gap between valve 9 and first tapered portion 10a or second tapered portion 10b of valve chamber 10. The rate, at which the air flows through the gap between air-supply port 11 and air-discharge port 12, is therefore adjusted. As a result, the air is jetted from air bag 3a through holes 3a' at the very rate suitable for maintaining the occupant's skin dry moderately to prevent him or her from having bedsores.

When disk 5a of air-distributing valve 5 stops rotating, the air is supplied to air bags 3a and 4a for a period longer than before. Further, the air is discharged from these air bags in the particular way as will be described. Thus, air bags 3a and 4a can be inflated and deflated to a specific degree, and air bags 3b and 4b can be inflated and deflated to a different degree.

While air bags 3a and 4a are inflated as mentioned above, air bags 3b and 4b remain communicating with the atmosphere and thus deflated, since air supply/discharge pipe 5d communicates with discharge pipe 5f through groove 5h.

When disk 5a is further rotated, thus connecting air supply pipe 5b to air supply/discharge pipe 5d via arcuate groove 5g, and connecting air discharge pipe 5e to air supply/discharge pipe 5c through arcuate groove 5h, the interiors of air bags 3a and 4b communicate with the atmosphere. Air bags 3a and 4b are thus deflated forthwith. On the other hand, air bags 3b and 4b are inflated, and the air is jetted from bag 3b through air-jetting holes 3b', against the back of the occupant of air mat 2. This sequence is periodically repeated.

Figure 7:
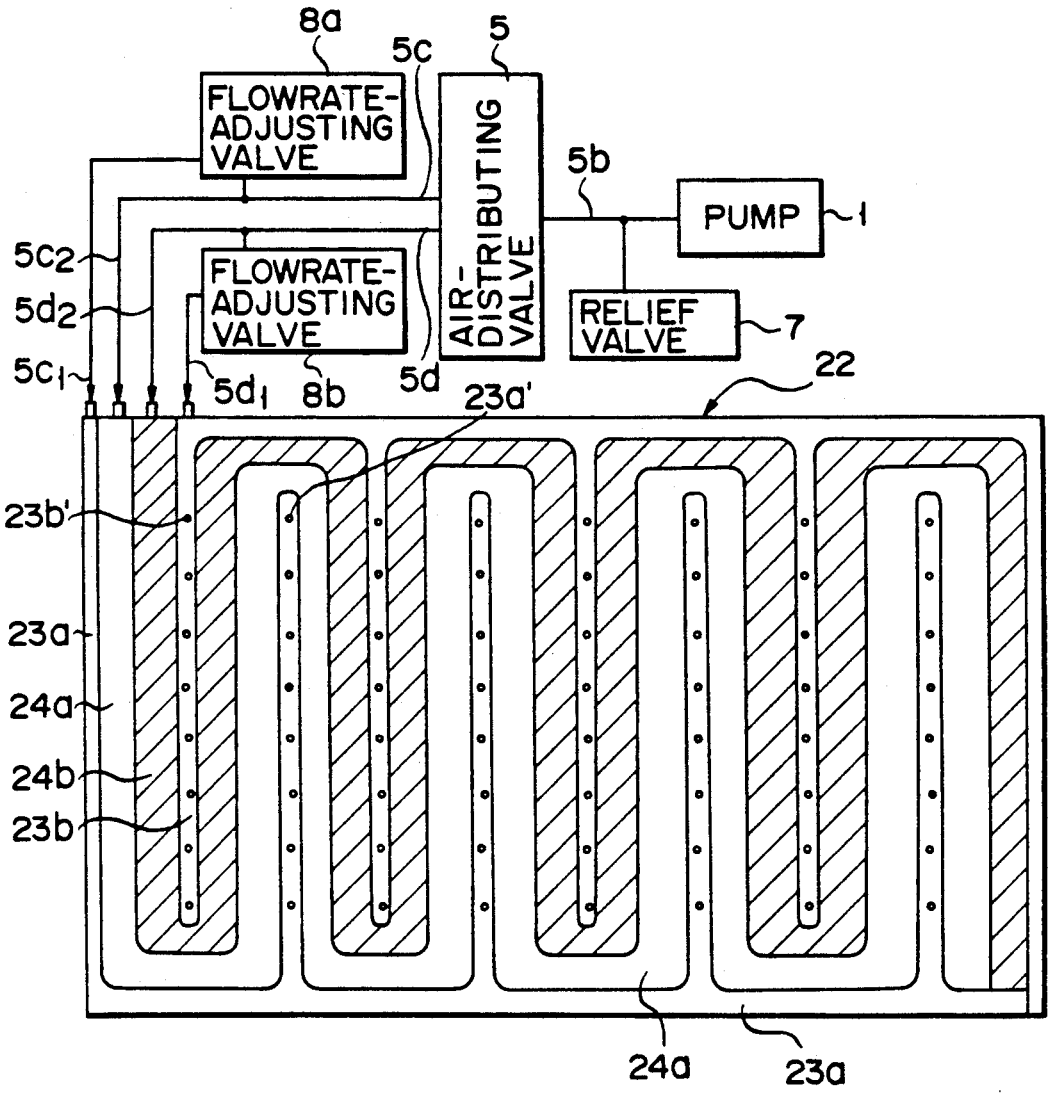
FIG. 7 is a block diagram illustrating an air-mat apparatus according to another embodiment of the present invention.

FIG. 7 shows an air-mat apparatus according to another embodiment of the present invention, and which includes an air mat 22 different in construction than the air mat 2 used in the air-mat apparatus shown in FIG. 2. Air mat 22 comprises two comb-shaped air bags 23a and 23b, and two zigzag air bags 24a and 24b. Air bags 23a and 23b have air-jetting holes 23a' and 23b', whereas air bags 24a and 24b have no holes. The finger-like portions of air bag 23a are located among the portions of air bags 24a which extend in the widthwise direction of air mat 22. Similarly, the finger-like portions of air bag 23b are located among those portions of air bags 24b which extend in the widthwise direction of air mat 22. As is evident from FIG. 7, zigzag air bags 24a and 24b are much thickener than comb-shaped air bags 23a and 23b which have air-jetting holes 23a' and 23b'.

Like air mat 2 of the first embodiment described above, air mat 2 comprises two groups of air bags, the first group consisting of air bags 23a and 24a, the former having air-jetting holes, and the latter having no holes, and the second group consisting of air bags 23b and 24b, the former having air-jetting holes, and the latter having no holes. However, these air bags 23a, 23b, 24a, and 24b are arranged in a different manner. More precisely, the bags having air-jetting holes and the bags having no holes are alternately arranged. Therefore, when the pressurized air is alternately supplied to, and discharged from, the two groups of air bags. As a result, air mat 22 makes a waving motion. Hence, the occupant of air mat 22 is supported first by the bags of the first group, and then supported by the bags of the second group. The occupant of this air mat 22 is therefore unlikely to have bedsores. In addition, since the pressurized air is jetted from air bags 23*a* and 23*b* every time they are inflated, it dries the occupant's back moderately, which also helps to relieve the occupant from bedsores.

As has been described above, the air mat of either embodiment of the invention has at least two groups of air bags, each group consisting of a bag having air-jetting holes and a bag having no holes. The air bags of each group are alternately inflated, and hence, alternately support the occupant of the air mat, thus reducing the possibility that the occupant has bedsored. Further, since a flowrate-adjusting valve is connected to each air bag having air-jetting holes, air is applied to the occupant's back at a rate optimum to his or her physical conditions. As a result, his or her back is maintained moderately dry, which helps to relieve him or her from bedsores.

What is claimed is:

1. An air-mat apparatus comprising;

a substantially rectangular air mat comprising first to fourth air bags closely arranged and air supply ports through which pressurized air is supplied to the air bags, the first bag having no holes and the second bag having air-jetting holes, the third bag having air-jetting holes and the fourth bag having no holes, wherein the first and second bags comprise a first group, and the third and fourth bags comprise a second group;

pressurized air supplying means for supplying air to the air supply ports of said air mat;

means for maintaining the supplying air at a predetermined pressure;

air-distributing means connected to said pressurized air-supplying means, for periodically distributing the pressurized air to be supplied to the first and second groups of bags;

air flow paths connected between said air-distributing means and said air mat; and user accessible flow-rate adjusting means connected to said air flow path which is connected to the second and third bags of the first and second groups, respectively, having holes, for individually adjusting the flow rate of the pressurized air flowing through said air flow path toward the second and third bags.

2. The air-mat apparatus according to claim 1, wherein said pressurized air-supplying means includes a pump for generating pressurized air, and a pressure-controlling valve for maintaining the pressurized air at the predetermined pressure.

3. The air-mat apparatus according to claim 1, wherein said air-distributing means includes an air-discharging path open to the atmosphere, and at least one air flow path which is connected, at one end, to either said pressurized air-supplying means or said air-discharging path such that when said one end is connected to said air supplying means, the pressurized air is supplied into the air bag connected to the other end of the air flow path, thereby to inflate this air bag.

4. The air-mat apparatus according to claim 3, wherein said air-distributing means connects said air flow path alternately to said pressurized air-supplying means and said air-discharging path, for predetermined period of time.

5. The air-mat apparatus according to claim 1, wherein two of said four air bags are arranged zigzag in mutual contact.

6. The air-mat apparatus according to claim 1, wherein two of said air bags are in mutual contact and are arranged in a zigzag pattern, and two other of said air bags are separated from each other by said two bags in said zigzag pattern and are generally comb-shaped.

7. The air-mat apparatus according to claim 1, wherein said air bags having air-jetting holes have a width smaller than that of said air bags having no holes.

8. The air-mat apparatus according to claim 5 wherein said two bags arranged zigzag are said second and third bags.

9. The air-mat apparatus according to claim 6 wherein said two bags arranged in a zigzag pattern are said second and third bags.

* * * * *

UNITED STATES PATENT AND TRADEMARK OFFICE

CERTIFICATE OF CORRECTION

PATENT NO. : 5,035,016

DATED : July 30, 1991

INVENTOR(S) : MORI et al.

It is certified that error appears in the above-identified patent and that said Letters Patent is hereby corrected as shown below:

In the title page, the Assignee, "Nikko Co., Ltd." should read --Nikki Co., Ltd.--.

Signed and Sealed this

Ninth Day of March, 1993

*Attest:*

STEPHEN G. KUNIN

*Attesting Officer*

*Acting Commissioner of Patents and Trademarks*